United States Patent [19]

Greenfield

[11] Patent Number: 4,886,710

[45] Date of Patent: Dec. 12, 1989

[54] MINING/CONSTRUCTION TOOL BIT HAVING BIT BODY FABRICATED FROM MN-B STEEL ALLOY COMPOSITION

[75] Inventor: Mark S. Greenfield, Cary, N.C.

[73] Assignee: Kennametal Inc., Latrobe, Pa.

[21] Appl. No.: 39,208

[22] Filed: Apr. 16, 1987

[51] Int. Cl.[4] ..... G22F 7/04

[52] U.S. Cl. ..... 428/564; 175/409; 175/411; 420/121

[58] Field of Search ..... 428/564; 420/121; 175/409, 411

[56] References Cited

U.S. PATENT DOCUMENTS

| | | | |
|---|---|---|---|
| 2,280,283 | 4/1942 | Crafts | 420/121 |
| 2,357,876 | 9/1944 | Crafts et al. | 420/121 |
| 2,527,731 | 10/1950 | Ilacqua et al. | 420/121 |
| 2,833,638 | 5/1958 | Owen | 428/564 |
| 3,449,685 | 3/1970 | Kniff | 299/86 |
| 3,519,309 | 7/1970 | Engle et al. | 299/86 |
| 3,720,273 | 3/1973 | McKenry et al. | 175/335 |
| 4,078,621 | 3/1978 | Dewar et al. | 175/409 |
| 4,136,230 | 1/1979 | Patel | 428/564 |
| 4,316,636 | 2/1982 | Taylor et al. | 299/92 |
| 4,446,196 | 5/1984 | Brown | 428/564 |
| 4,464,209 | 8/1984 | Taira et al. | 420/121 |
| 4,491,476 | 1/1985 | Tada et al. | 420/121 |
| 4,497,520 | 2/1985 | Ojanen | 299/86 |
| 4,562,892 | 1/1986 | Ecer | 175/409 |

FOREIGN PATENT DOCUMENTS

| | | | |
|---|---|---|---|
| 56-87652 | 7/1981 | Japan | 420/121 |

OTHER PUBLICATIONS

"Boron Steels Targeted for Low-Cost Through-Hardness, Tooling and Production", Mar. 1985, pp. 99, 100.

*Primary Examiner*—Stephen J. Lechert, Jr.
*Attorney, Agent, or Firm*—John J. Prizzi

[57] ABSTRACT

A mining and construction bit body is composed of a Mn-B steel alloy composition. The alloy content of the composition in percents by weight includes: carbon, 0.33–0.38; manganese, 1.10–1.35; boron, 0.0005 minimum; silicon 0.15–0.30; sulfur, 0.045 maximum; and phosphorus, 0.035 maximum. The composition has a minimum hardenability of 47 Rockwell C at the Jominy 6/16 position and a maximum as-rolled hardness of 22 Rockwell C such that without anneal the composition meets hardenability and machinability requirements that make it useful for fabricating mining and construction bit bodies of all sizes. The mining and construction bit body is made by a process which includes the steps of, first, providing a rod in an as-rolled condition and being composed of the Mn-B steel alloy composition having the above-defined alloy content, then, machining the rod in its as-rolled condition without an anneal to the desired size and shape of the bit body, and, finally, heat treating the bit body to obtain the desired mechanical properties of hardness and toughness. The heat treating step includes heating the bit body to a temperature above 1550 degrees F., subjecting the bit body to quenching at a severity of approximately 0.7 H value to cool and harden it, and tempering it to improve its toughness. The quenching can occur in one of of oil, water or a polymer-water mixture.

5 Claims, 1 Drawing Sheet

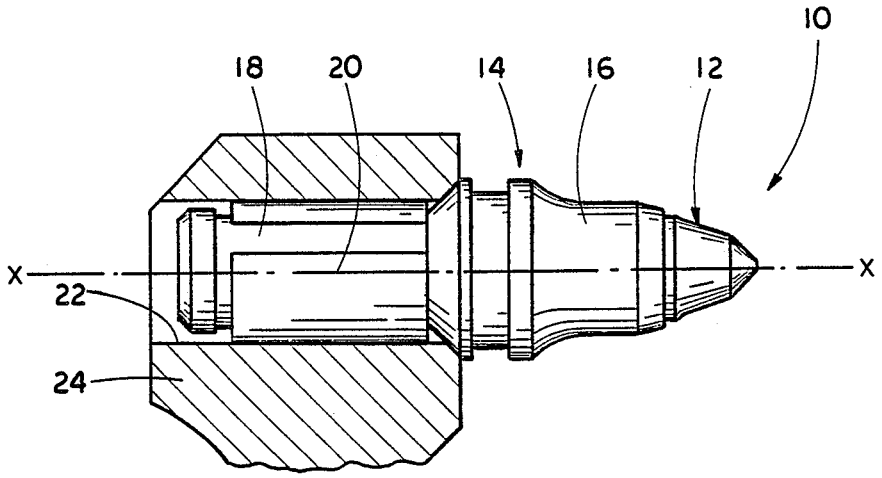
10
18
20
14
16
12
X
X
22
24

MINING/CONSTRUCTION TOOL BIT HAVING BIT BODY FABRICATED FROM MN-B STEEL ALLOY COMPOSITION

BACKGROUND OF THE INVENTION

1. Field of the Invention

The present invention relates generally to mining and construction tools and, more particularly, is concerned with a Mn-B steel alloy composition from which to fabricate a mining and construction bit body and with a process of fabricating the body.

2. Description of the Prior Art

Many mining and construction tools employ drums and the like on which are mounted a multiplicity of rotary cutter bits. Typically, each bit has an elongated body which at its forward end has brazed thereon a hard wear resistant, pointed tip which contacts the formation. Heretofore, hard tips have been composed of any one of several different grades of cemented tungsten carbide composition, whereas bit bodies have typically been fabricated from any one of several standard steel alloys, such as AISI Nos. 414OH, 863OH and 874OH. Representative of the prior art are the cutter bits disclosed in U.S. Pats. to Kniff (3,499,685), Engle et al (3,519,309), McKenry et al (3,720,273), Stephenson (4,216,832), Taylor et al (4,316,636) and Ojanen (4,497,520).

The conventional process for fabricating a bit body from one of the standard steel alloys is to start with a rod composed of the steel alloy and having an diameter size sufficient to allow machining to the desired final bit body size (the maximum being two inches). Next, the rod is annealed to soften it and thereby facilitate its machinability. Then, the rod is machined to the desired final bit body size and shape. Following next, the bit body is heat treated to obtain the desired mechanical properties of hardness and toughness. The heat treatment includes heating the bit body to a temperature above 1550 degrees F., next, subjecting the bit body to quenching in oil, water or polymer based quenchants to cool and harden it, and, finally, tempering it to improve its toughness. The carbide tip is brazed to the bit body either before or after the heat treatment or concurrently therewith.

In the course of operating mining and construction tools, the bits are forcibly engaged with coal and rock formations to reduce and remove the same and thus are subjected to a high degree of stress and wear. Failure of bit bodies used in mining and construction is due primarily to a bending or breaking moment. Stress produced by the bending moment is at a maximum at the surface of the bit body and decreases to a minimum or zero at its center or axis. Thus, the steel alloys from which the bit bodies are fabricated must have at least a minimum hardenability in order to make the bodies fabricated therefrom capable of withstanding such bending stresses. However, the steel alloys used heretofore that have adequate hardenability properties, must be annealed in order to meet machinability requirements. This necessity for annealing the rods increases the cost of processing the material and ultimately increases the cost of the bit body, for instance by about ten to twenty percent.

Although bit bodies constructed from the standard steel alloys used heretofore have been satisfactory overall, there is a constant need for improvements in the material composing the bit body and the process of fabricating the body in order to further reduce costs but without sacrificing its desired minimum design properties.

SUMMARY OF THE INVENTION

The present invention provides a mining/construction bit having a bit body fabricated of a Mn-B steel alloy composition and by a process designed to satisfy the aforementioned needs. The composition of the present invention provides a heat treatable material for bar sizes which covers all sizes of bit bodies up to two inch diameter and provides suitable machinability in an as-rolled (unannealed) condition. The composition meets the minimum design properties for bit body applications with a less expensive material. It also has suitable machinability in an as-rolled (unannealed) condition thereby providing an additional cost savings by eliminating the need for an annealing step in the bit body fabrication process. Further, it has the benefit of a lower core hardness than standard steel alloys and goes through martenistic transformation at a higher temperature than standard steel alloys which together have the combined effect of reducing residual surface tensile stresses and brazing stresses which will improve field performance of the bit bodies. Thus, the composition of the present invention is more cost effective than prior standard steel alloys.

Accordingly, the present invention is directed to a Mn-B steel alloy composition in which the alloy content in percents by weight comprises: carbon, 0.33–0.38; manganese, 1.10–1.35; boron, 0.0005 minimum; silicon 0.15–0.30; sulfur, 0.045 maximum; and phosphorus, 0.035 maximum, wherein the composition has a minimum hardenability of 47 Rockwell C at the Jominy 6/16 position and a maximum as-rolled hardness of 22 Rockwell C such that without anneal the composition meets hardenability and machinability requirements that make it useful for fabricating mining and construction bit bodies of all sizes. More particularly, a range of 0.020–0.030 of sulfur is preferred to aid in machinability. Further, the present invention is directed to a mining and construction bit body being composed of the Mn-B steel alloy composition having the above-defined alloy content.

Still further, the present invention is directed to a process for making a mining and construction bit body, comprising the steps of: (a) providing a rod in an as-rolled condition and being composed of the Mn-B steel alloy composition having the above-defined alloy content; (b) machining the rod in its as-rolled condition without an anneal to the desired size and shape of a bit body; and (c) heat treating the bit body to obtain the desired mechanical properties of hardness and toughness. More particularly, the heat treating step includes: (i) heating the bit body to a temperature above 1550 degrees F; (ii) subjecting the bit body to quenching at a severity of approximately 0.7 H value to cool and harden it; and (iii) tempering the bit body to improve its toughness. The quenching occurs in one of oil, water or a polymer-water mixture. The process further comprises the step of brazing a carbide tip to the bit body either before or after the heat treating step or concurrently therewith.

These and other advantages and attainments of the present invention will become apparent to those skilled in the art upon a reading of the following detailed description when taken in conjunction with the drawing wherein there is shown and described an illustrative embodiment of a bit employing the present invention.

BRIEF DESCRIPTION OF THE DRAWINGS

In the course of the following detailed description, reference will be made to the attached drawing in which the single FIGURE is a side elevational view of an exemplary cutter bit being mounted on a block and having a bit body constructed in accordance with the present invention.

DETAILED DESCRIPTION OF THE INVENTION

In the following description, like reference characters designate like or corresponding parts. Also in the following description, it is to be understood that such terms as "forward", "rearward", "left", "right", "upwardly", "downwardly", and the like, are words of convenience and are not to be construed as limiting terms.

Referring now to the single figure of the drawing, there is shown a rotary cutter bit, generally designated by the numeral 10, which can be mounted in a conventional manner on tools (not shown) intended for use in applications such as mining and construction. The cutter bit 10 includes a hard pointed tip 12 and an elongated bit body 14. The hard tip 12 is typically fabricated of tungsten carbide. The bit body 14 is composed of a steel alloy composition and fabricated by a process which together comprise the present invention and will be described in detail hereinafter.

The bit body 14 has a forward body portion 16 and a rearward shank portion 18 which are construced as a single piece. The tip 12 is attached to the forward body portion 16 by a conventional braze joint (not shown). The solitary cemented tungsten carbide tip 12 and the bit body 14 are rotationally symmetric about a common longitudinal axis, x-x. A cylindrical retention spring 20, which is longitudinally slotted and made of resilient material, encompasses the shank portion 18 of the bit 10 and adapts the bit for mounting in a socket 22 of a block 24 which is, in turn, mounted on a drum (not shown). The retention spring 20 tightly engages the socket 22 and loosely engages the bit shank portion 18, allowing the bit to rotate about its longitudinal axis, x-x during use.

In accordance with the present invention, the bit body 14 is composed of a Mn-B steel alloy composition having an alloy content composed of the following chemical elements in the following percents by weight:

Carbon: 0.33–0.38
Manganese: 1.10–1.35
Boron: 0.0005 min.
Silicon: 0.15–0.30
Sulfur 0.045 max.
Phosphorus 0.0035 max.

The first three elements—carbon, manganese and boron—are critical for this alloy. The latter three elements are standard ranges for carbon steels. A range of 0.020–0.030 of sulfur is preferred to aid in machinability. Other machinability enhancing elements such as lead, selenium, calcium, bismuth, etc. may be added. A minimum hardenability of 47 Rockwell C at the Jominy position of 6/16 and a maximum as-rolled hardness of 22 Rockwell C or 235 BHN are also requirements met by the composition. This steel chemistry provides a heat treatable material for bar sizes up to two inches that also provides suitable machinability in an as-rolled (unannealed) condition.

None of the standard alloy and carbon "H" band steels meet these requirements. AISI alloy 50B40H provides a 48 Rockwell C hardness at the Jominy position of 6/16, but shows a maximum 29 Rockwell C hardness at the 32/16 position. This relatively slow drop in hardness indicates that an anneal would be required. This alloy would generally be machined in the annealed condition with a hardness in the range of 174–223 BHN. The closest carbon steel meeting the minimum hardenability requirement is AISI 15B41H which has a 50 Rockwell C hardness minimum at the Jominy 6/16 position and a 31 Rockwell C hardness at the 32/16 position. Experience has indicated that an as-rolled hardness of 25 Rockwell C hardness can be expected at nominal chemistry and requires an anneal for machining.

The composition of the present invention falls within the ranges of the elements of AISI 15B37H carbon steel which are as follows:

Carbon: 0.31–0.39
Manganese: 1.00–1.50
Boron: 0.0005 min.
Silicon: 0.15–0.30
Sulfur: 0.045 max.
Phosphorus: 0.035 max.

However, given the broad chemistry of 15B37H and its range at the Jominy 6/16 position of 52 to 37 Rockwell C hardnesses, this broad composition fails to provide adequate hardenability at its lower end and would require annealing at its upper limits for machinability. Thus, although the narrow chemistry of the composition of the present invention is a subset of the broad chemistry of 15B37H, unlike 15B37H whose physical properties would only adapt it for use in fabrication of mining and construction bit bodies up to diameters of one and one-sixteen inch, the composition of the present invention unexpectedly has the necessary physical properties for making it useful in fabrication of mining and construction bit bodies of all sizes without any requirement for annealing to facilitate machinability.

The process of the present invention for making the mining and construction bit body 14 basically comprises the steps of starting with a rod in an as-rolled condition and being composed of the Mn-B steel alloy composition of the above-defined alloy content of the present invention, and machining the rod in its as-rolled condition without an anneal to the desired size and shape of the bit body 14. Then, the bit body 14 is heat treated to obtain the desired mechanical properties of hardness and toughness. More particularly, the bit body 14 is heat treated, first, by heating the bit body to a temperature above 1550 degrees F, then, by subjecting the bit body to quenching at a severity of approximately 0.7 H value to cool and harden it, and, finally, by tempering it to improve its toughness. The quenching can occur in one of oil, water or a polymer-water mixture. The oil can be Quenchtex C and the polymer can be Park Quench #90. Finally, the carbide tip 12 can be brazed to the bit body 14 either before or after the heat treating step or concurrectly therewith.

Thus, it is seen that the bit body 14 is fabricated by a process generally similar to the prior fabrication process described in the background section supra but with an important ommission, that being the anneal step. Also, the process of the present invention envisions a severe quenching step in the heat treatment of the bit body 14 which is different from that used heretofore. Particularly, heretofore, quenching was generally carried out by oil quenching with a quench severity of approximately 0.5 H value.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

I claim:

1. In a mining and construction bit for mounting in a socket of a block, a bit body elongated about a longitudinal axis and having a forward body portion and a rearward body portion; a solitary cemented tungsten carbide tip attached to said forward body portion; a retaining means for rotatably retaining said bit in the socket of a block, whereby said bit is rotatable about said longitudinal axis; said retaining means loosely mounted on said rearward shank portion; said tungsten carbide tip and said bit body rotationally symmetric about said longitudinal axis; said bit body being composed of a Mn-B steel alloy composition the alloy content of which in percents by weight comprising: carbon, 0.33–0.38; manganese, 1.10–1.35; boron, 0.0005 minimum; silicon 0.15–0.30; sulfur, 0.045 maximum; and phosphorus, 0.035 maximum, wherein said composition has a minimum hardenability of 47 Rockwell C at the Jominy 6/16 position and a maximum as-rolled hardness of 22 Rockwell C such that without anneal said composition meets hardenability and machinability requirements that make it useful for fabricating mining and construction bit bodies of all sizes.

2. The bit body as recited in claim 1, wherein a range of 0.020–0.030 of sulfur is preferred to aid in machinability.

3. A mining and construction bit, comprising:

(a) a hard carbide tip; and (b) an elongated bit body having said tip attached on a forward end of said body by a braze joint, said elongated bit body having a rearward shank portion, a retaining means loosely mounted on said rearward shank portion, said hard carbide tip and said elongated bit body being rotationally symmetric about a common longitudinal axis, said bit body being composed of a Mn-B steel alloy composition the alloy content of which in percents by weight comprising: carbon, 0.33–0.38; manganese, 1.10–1.35; boron, 0.005 minimum; silicon 0.15–0.30; sulfur, 0.045 maximum; and phosphorus, 0.035 maximum, wherein said composition has a minimum hardenability of Rockwell C at the Jominy 6/16 position and a maximum as-rolled hardness of 22 Rockwell C such that without anneal said composition meets hardenability and machinability requirements that make it useful for fabricating mining and construction bit bodies of all sizes.

4. A mining and construction bit comprising:

a cemented tungsten carbide tip brazed to an elongated bit body; said elongated bit body having a rearward shank portion; a retaining means loosely mounted on said rearward shank portion; said cemented tungsten carbide tip and said elongated bit body being rotationally symmetric about a common longitudinal axis;

said elongated bit body composed of a Mn-B steel alloy consisting of:

0.33–0.38 weight percent carbon;

1.10–1.35 weight percent manganese;

0.0005 weight percent minimum boron;

0.15–0.30 weight percent silicon;

0.045 weight percent maximum sulfur;

0.035 weight percent maximum phosphorus;

with the remainder being essentially iron;

wherein said steel alloy has a minimum hardenability of 47 Rockwell C at the Jominy 6/16 position and a maximum as-rolled hardness of 22 Rockwell C such that without anneal said composition meets hardenability and machinability requirements that make it useful for fabricating mining and construction bit bodies of all sizes.

5. The mining and construction bit according to claim 4 wherein the sulfur content is 0.020 to 0.030 weight percent.

* * * * *